US008616329B1

(12) United States Patent
Welter et al.

(10) Patent No.: US 8,616,329 B1
(45) Date of Patent: Dec. 31, 2013

(54) AIR COUPLED ACOUSTIC APERIODIC FLAT LENS

(71) Applicant: The United States of America as represented by the Secretary of the Air Force, Washington D.C., OH (US)

(72) Inventors: John T Welter, Fairborn, OH (US); Shamachary Sathish, Bellbrook, OH (US); Daniel Christensen, Omaha, NE (US); Jason D Heebl, El Segundo, CA (US); Philip Brodrick, Cincinnati, OH (US); Matthew R Cherry, Dayton, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 13/663,674

(22) Filed: Oct. 30, 2012

(51) Int. Cl.
*G10K 13/00* (2006.01)

(52) U.S. Cl.
USPC ..... 181/176; 181/167

(58) Field of Classification Search
USPC ..... 1/176; 181/176, 167
See application file for complete search history.

(56) References Cited

U.S. PATENT DOCUMENTS

| | | | | | |
|---|---|---|---|---|---|
| 2,684,725 | A * | 7/1954 | Kock | ..... | 181/176 |
| 3,957,134 | A * | 5/1976 | Daniel | ..... | 181/176 |
| 4,779,241 | A | 10/1988 | Atalar et al. | | |
| 4,888,861 | A * | 12/1989 | Day | ..... | 29/25.35 |
| H002049 | H * | 10/2002 | Sathish et al. | ..... | 736/642 |
| 6,554,826 | B1 | 4/2003 | Deardorff | | |
| 7,316,290 | B2 * | 1/2008 | Hutt et al. | ..... | 181/176 |

FOREIGN PATENT DOCUMENTS

| | | | | | |
|---|---|---|---|---|---|
| GB | 2004170 A | * | 3/1979 | ..... | G10K 11/06 |
| WO | WO 2011131819 | * | 4/2011 | ..... | G10K 11/30 |

OTHER PUBLICATIONS

Briggs et al., "Acoustic Microscopy", Oxford University Press, New York, 2009.
Fortunko et al., "Gas-coupled acoustic microscopy in the pulse-echo mode," Proc. IEEE Ultrasonics Symp. 2, 667-671, 1993.
Bhardwaj, M.C., "Evolution of piezoelectric transducers to full scale non-contact ultrasonic analysis mode," World Conference on Non-Destructive Testing, Montreal, Canada 2004.
Born et al., "Principles of Optics: Electromagnetic Theory of Propagation, Interference and Diffraction of Light," 6th ed., Pergamon, New York, 1991.
Hadimioglu et al., "High-efficiency Fresnel acoustic lenses," Proc. IEEE Ultrasonics Symp. 1, 579-582, 1993.
Pendry, J.B., "Negative refraction makes a perfect lens," Phys. Rev. Lett. 85, 3966-3969, 2000.

(Continued)

*Primary Examiner* — Forrest M Phillips
(74) *Attorney, Agent, or Firm* — AFMCLO/JAZ; Charles Figer, Jr

(57) ABSTRACT

A broadband acoustic lens and method of designing same is provided for focusing an incident acoustic wave. The broadband lens includes a plurality of concentric rings, where each concentric ring of the plurality of concentric rings has a ring width, and a plurality of gaps, where each gap of the plurality of gaps has a spacing. The concentric rings are separated by a spacing corresponding to a gap of the plurality of gaps. The widths of the plurality of concentric rings and the spacings of the plurality of gaps are arranged such that the incident acoustic wave is focused to a spot within a sub-wavelength of the incident acoustic wave in air. The arrangement of the widths of the plurality of concentric rings and spacings of the plurality of gaps is aperiodic.

12 Claims, 4 Drawing Sheets

(56) References Cited

OTHER PUBLICATIONS

Fang et al., "Ultrasonic metamaterials with negative modulus," Nature Mater. 5, 452-456, 2006.
Guenneau et al., "Acoustic metamaterials for sound focusing and confinement," New J. Phys. 9, 399, 2007.
Zhang et al., "Focusing ultrasound with an acoustic metamaterial network," Phys. Rev. Lett. 102, 194301, 2009.
Lee et al., "Acoustic metamaterial with negative modulous," J. Phys.: Condens. Matter 21m 175704, 2009.
Huang et al., "Wave attenuation mechanism in acoustic metamaterial with negative effective mass density," New J. Phys. 11, 013003, 2009.
Zhang et al., "Far-field imaging of acoustic waves by a two-dimensional sonic crystal," Phys. Rev. B 71, 054302, 2005.
Feng et al., "Negative refraction of acoustic waves in two-dimensional sonic crystals," Phys. Rev. B 72, 033108, 2005.
Cai et al., "High refractive=index sonic material based on periodic subwavelength structure," Appl. Phys. Lett. 91, 203515, 2007.
Ao et al., "Far-field image magnification for acoustic waves using anisotropic acoustic metamaterials," Phys. Rev. E 77, 025601(R), 2008.
Thongrattansiri et al., "Hypergratings: nanophotonics in planar anisotropic metamaterials," Opt. Lett. 34, 890-892, 2009.
Håkansson et al., "Sound focusing by flat acoustic lenses without negative refraction," Appl. Phys. Lett. 86, 054102, 2005.
Torrent et al., "Acoustic metamaterials for two-dimensional sonic devices," New J. Phys. 9, 323, 2007.
Grbic et al., "Near-field plates: subdiffraction focusing with pattered surfaces," Science 320, 511-513, 2008.
Imani et al., "Near field focusing with a corrugated surface," IEEE Antennas Wireless Propag. Lett. 8, 421-424, 2009.
Chen et al., "Metamaterial with randomized patterns for negative refraction of electromagnetic waves," Appl. Phys. Lett 88, 031908, 2008.
Sanchis et al., "Three-dimensional acoustic lenses with axial symmetry," Appl, Phys. Lett. 97, 054103, 2010.
Twerdoski et al., "Acoustic holographic imaging by scanning point contact excitation and detection in piezoelectric materials," 9th European Conference on NDT, Berlin Germany, Sep. 2006.
Veselago, V.G., "The electrodynamics of substances with simultaneously negative values of E and μ," Soy. Phys. Usp. 10, 509-514, 1968.
Deng et al., "Theoretical study of subwavelength imaging by acoustic metamaterial slabs," J. Appl. Phys. 105, 124909, 2009.
Li et al., "Experimental demonstration of an acoustic magnifying hyperlens," Nature Mater. 8, 931-934, 2009.
Farhat et al., "Focussing bending waves via negative refraction in perforated thin plates," Appl. Phys. Lett. 96, 081909, 2010.
Lemoult et al., "Acoustic Resonators for Far-Field Control of Sound on a Subwavelength Scale," Phys. Rev. Lett. 107, 064301,2011.
Spiousas et al., "Experimental realization of broadband tunable resonators based on anisotropic metafluids," Appl. Phys. Lett. 98, 244102, 2011.
Zigoneanu et al., "Design and measurements of a broadband two-dimensional acoustic lens," Phys. Rev. B 84, 024305, 2011.
Ding et al., "Multi-band and broadband acoustic metamaterial with resonant structures," J. Phys. D: Appl. Phys. 44 215402, 2011.
Casse et al., "Super-resolution imaging using a three-dimensional metamaterials nonlens," Appl. Phys. Lett. 96, 023114, 2010.
Morse et al., "Theoretical Acoustics", Princeton University Press, New Jersey, 1986.
Torrent et al., "Anisotropic Mass Density by Radially Periodic Fluid Structures," Phys. Rev. Lett. 105, 174301, 2010.
Durig et al, "Nearfield opticalscanning microscopy," J. Appl. Phys. 59, 3318, 1986.

* cited by examiner

AIR COUPLED ACOUSTIC APERIODIC FLAT LENS

RIGHTS OF THE GOVERNMENT

The invention described herein may be manufactured and used by or for the Government of the United States for all governmental purposes without the payment of any royalty.

BACKGROUND OF THE INVENTION

1. Field of the Invention

The present invention generally relates to focusing acoustic waves and, more particularly, to focusing utilizing acoustic lenses.

2. Description of the Related Art

Concepts of a "superlens" and its development have expanded the understanding of wave propagation and imaging across all fields of science and engineering. It is well known, from the theory of diffraction, that focusing of waves is limited by diffraction and the spatial resolution is determined by the Rayleigh criterion. The concept of the superlens has provided an avenue to obtain resolution beyond the classical diffraction limit. In general, in electromagnetic waves, the superlensing effect originates from a negative $\mu$ and negative $\epsilon$, leading to negative refractive index. While natural materials may not exhibit negative refractive indices, artificial structures with sub-wavelength spacing have demonstrated negative refractive indices. These new classes of structure that have a negative refractive index are known as metamaterials. An important consequence of the negative refractive index in wave propagation is that the "wave velocity" and the group velocity are in opposite direction to each other. The experimental demonstration of superlens effect in electromagnetic wave propagation has quickly spread into many fields including acoustics. Three dimensional acoustic metamaterials and structures have been developed, based on anisotropic wave propagation and observation of wave velocity and group velocity to be in opposite directions along specific directions in the structures.

Following the development of metamaterials, the possibility of achieving acoustic wave focusing beyond diffraction limit with two-dimensional structures has been explored. Many of these approaches use Helmholtz resonators or a split ring type resonator. Additionally, two-dimensional periodic and aperiodic arrays have demonstrated acoustic wave focusing. Some designs include two dimensional grating with aperiodic spacing, which is less than the wavelength of microwave radiation and have demonstrated focusing beyond the diffraction limit. Following similar arguments several groups have designed two dimensional grating structures to focus electromagnetic waves and have demonstrated focusing beyond the diffraction limit. Most of the acoustic gratings reported are parallel lines and the focusing has been along a line.

Typically focusing of acoustic waves has been achieved with lens structures based on refraction. Single element acoustic lenses based on refraction are an integral part of scanning acoustic microscopy (SAM). In SAM high frequency acoustic waves have been brought to focus with an acoustic lens on to the surface of a sample in presence of a coupling liquid. Single element acoustic lenses have been used to focus acoustic waves in presence of high pressure gases and in ambient air. The focal spot size in single element lenses has been limited by diffraction and the spatial resolution, s, as determined by the Rayleigh criterion, $s=1.22(\lambda/D)$, where $\lambda$ is the wavelength of sound in the coupling medium and D is the diameter of the lens, similar to the electromagnetic waves above. A single element acoustic lens typically consists of a cylindrical rod with a piezoelectric transducer attached at one end. The opposite end generally has a spherical curvature that contacts the coupling liquid. Although these structures have been demonstrated to have better resolution, they operated only in a narrow frequency range and had serious practical limitations.

Planar acoustic lens structures based on Fresnel diffraction have also been developed for focusing of acoustic waves. The focal spot size and spatial resolution of Fresnel lenses are also determined by diffraction theory and the Rayleigh criterion. Although Fresnel lenses have planar structure, the individual corrugations may have thickness variations or steps for matching the phase of the acoustic field at the focal spot. Acoustic Fresnel lenses may also consist of a cylindrical rod with corrugations on one end and a piezoelectric transducer at the opposite end. The corrugated structure is immersed in coupling fluid to focus acoustic waves on the sample surface. Both single element lenses and Fresnel lenses have been used to focus acoustic fields only in the far field.

Aperiodic grating structures have additionally been explored for acoustic focusing. Aperiodic grating structures are generally optimized to achieve acoustic focusing in the near field through a combination of near field diffraction and multiple scattering theories. Initially the concept was demonstrated by focusing an acoustic beam to a line by optimally arranged cylindrical rods. This has been extended to focus acoustic waves to circular spot by optimally arranging a ring structure with axial symmetry. This particular lens consisted of several rings of varying diameters arranged with the centers aligned along the line. The distance between rings, diameter of the rings and positioning of the rings was optimized in three dimensions using a genetic algorithm to operate at 2.2 kHz. Although the lens has a circular acoustic focal spot for acoustic imaging applications the three-dimensional structure was quite complicated.

Contemporary three dimensional and two dimensional periodic and aperiodic array structures have been designed to achieve subwavelength focusing. However, subwavelength resolution in a narrow band frequency range is commonly observed. Demonstration over broad frequency ranges has been limited. A cylindrical acoustic lens structure has been used to show continuous focusing over the 4.2-7 kHz frequency band with up to $\lambda/4.1$ focusing. However, this lens had focal regions at every demonstrated frequency. Other types of broadband tunable resonators were demonstrated based on anisotropic metafluids with structures consisting of corrugated, periodic cylinders in a fluid. These structures operated in the frequency range of 1-5 kHz, with up to 4 clearly defined resonances at which the amplitude of the acoustic pressure was high. An approach using a two dimensional periodic unit cell acoustic lens with a broad bandwidth and a graded refractive index medium was developed and demonstrated to operate in the range of 1.5-4.5 kHz. Multiband and broadband acoustic structures based on split hollow spheres have been demonstrated between 0.9-1.6 kHz. The multiband structure had three distinct resonances while the broadband structure had six distinct resonances. With the exception of the cylindrical acoustic lens, all the other acoustic lenses had bandwidths in the range of 0.9-5 kHz with very few resonances for evaluation of the spatial resolution. Subwavelength spatial resolution at each of the reported resonant frequencies was not clearly established.

Developing structures to focus acoustic waves to a circular spot in air could be important in acoustic imagining of materials. It is also expected that focusing such waves could significantly enhance capabilities of non-contact air coupled acoustic non-destructive evaluation. Accordingly, there is a need in the art for a broadband acoustic lens with clearly established subwavelength spatial resolution.

SUMMARY OF THE INVENTION

Embodiments of the invention provide a broadband acoustic lens for focusing an incident acoustic wave. The embodiments include a plurality of concentric rings, each having a ring width, and a plurality of gaps. The concentric rings are separated by a spacing corresponding to a gap of the plurality of gaps. The widths of the plurality of concentric rings and the spacings of the plurality of gaps are arranged such that the incident acoustic wave is focused to a spot within a sub-wavelength of the incident acoustic wave in air. Additionally, the arrangement of the widths of the plurality of concentric rings and spacings of the plurality of gaps is aperiodic.

In some embodiments of the broadband acoustic lens, the aperiodic arrangement of the widths of concentric rings and the gaps focuses the incident acoustic wave to a spot within a sub-wavelength of the incident acoustic wave at a plurality of acoustic frequencies. Some embodiments of the acoustic lens include an interconnecting webbing between the plurality of concentric rings to maintain the spacings of the plurality of gaps. In one of these embodiments, the webbing interconnecting the plurality of concentric rings divides the acoustic lens into four quadrants.

The plurality of concentric rings in some embodiments of the invention consist of aluminum. In some embodiments, each of the plurality of concentric rings of the broadband acoustic lens has an equal thickness and is coplanar. In other embodiments, the aperiodic arrangement of the widths of the plurality of concentric rings and spacings of the plurality of gaps is axially symmetric.

A method of designing a broadband acoustic lens is also provided. A plurality of initial seed designs is generated. A design is selected from the plurality of initial seed designs using a fitness function. A first parent design is generated from the selected design. The first parent design is optimized to generate a second parent design. The first and second parent designs are then mated to generate a plurality of offspring. Each of the plurality of offspring is evaluated to select a candidate solution. In response to the candidate solution not meeting a stop criteria, the first parent is set as the candidate solution and the optimizing, mating, and evaluating are repeated.

In some embodiments of the design method, the first parent design is optimized utilizing a greedy algorithm. In some embodiments, the fitness function may include maximum pressure, minimum spot diameter, distance of a spot from a lens, and combinations thereof. In some embodiments, the method may also include inputting analysis parameters for generating the plurality of initial seed designs. In these embodiments, the analysis parameters may include material properties of air, material properties of rings, operating frequency, width of acoustic field, design limitations, and combinations thereof.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

Figure 1:
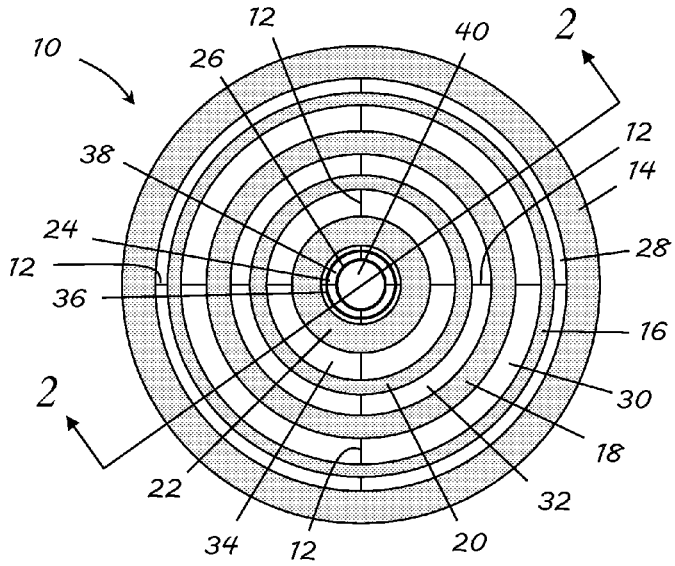
FIG. 1 is an exemplary acoustic lens consistent with embodiments of the invention.

Embodiments of the invention provide sub-wavelength focusing with a flat lens. The general structure of the lens, as seen in FIG. 1, is a concentric ring structure with aperiodic ring width and spacing (gaps). The exemplary acoustic lens 10, includes four webs 12 to connect the rings 14, 16, 18, 20, 22, 24, 26 together at the rings' quadrants. The four webs 12 provide only support of the rings 14, 16, 18, 20, 22, 24, 26 in order to maintain proper spacing. While four webs were used in this exemplary embedment, any number of webs may be used to support the ring structure, though care should be taken to ensure that the web structure does not introduce significant interference in the lens structure.

The structure for the exemplary lens 10 is machined out of a solid piece of aluminum using an electrical discharge machining process. It is envisioned that this lens 10 could be made out of other materials as well, such as plastics, rubbers, or other metals, and that the lens 10 may be produced by other manufacturing processes such as machining, casting, etc., as long as the manufacturing process can provide the necessary shape and feature sizes. Additionally, other embodiments of lens 10 may be composed of rings having different material properties, e.g., where some rings may be aluminum, some may be rubber and some may be plastic. These embodiments may benefit from the different materials as the different materials have different properties and multiple materials working together may yield more efficient lenses. The exemplary lens 10 is designed for an input frequency of approximately 80-90 kHz. However, it is envisioned that the feature and ring dimensions, as well as the number of rings, of other embodiments of the invention are easily changed to optimize performance at higher or lower frequencies. Therefore, the invention, as envisioned, is not limited to any one frequency or frequency bandwidth or to a specific number of features, feature spacing, feature dimension, or material properties.

Figure 2:
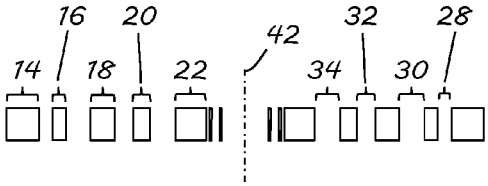
FIG. 2 is a cross section of the exemplary acoustic lens in FIG. 1.
Figure 2A:
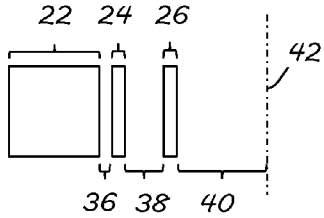
FIG. 2A is a magnified portion of the cross section in FIG. 2.

FIGS. 2 and 2A illustrate a cross section of the exemplary lens 10 in FIG. 1. This exemplary embodiment includes seven rings 14, 16, 18, 20, 22, 24, 26 separated by gaps 28, 30, 32, 34, 36, 38, 40. The rings are concentric about a center axis 42, with the center most gap 40 having a diameter of approximately 4.0 mm. Dimensions of the rings and gaps of the exemplary embodiment may be found in the following table.

| Gap/Ring | Dimension |
|---|---|
| Ring 14 | 3.000 mm |
| Gap 28 | 1.143 mm |
| Ring 16 | 1.143 mm |
| Gap 30 | 2.285 mm |
| Ring 18 | 2.000 mm |
| Gap 32 | 1.715 mm |
| Ring 20 | 1.428 mm |
| Gap 34 | 2.286 mm |
| Ring 22 | 2.571 mm |
| Gap 36 | 0.286 mm |
| Ring 24 | 0.286 mm |
| Gap 38 | 0.571 mm |
| Ring 26 | 0.286 mm |
| Gap 40 | 2.000 mm |

Figure 3:
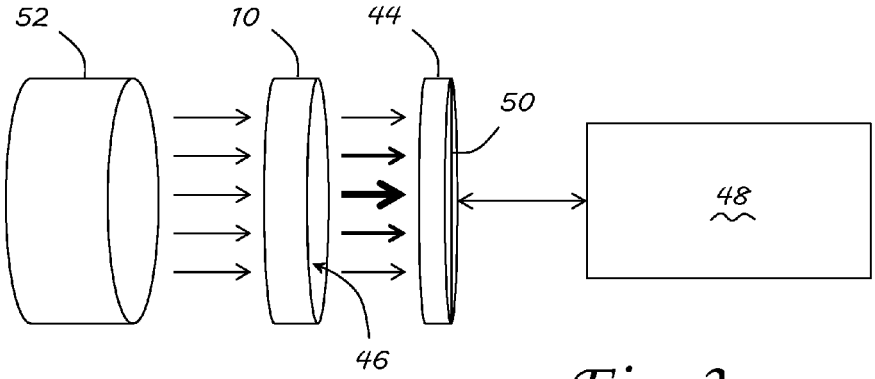
FIG. 3 is a block diagram of a system for exciting an acoustic lens, such as the exemplary lens in FIG. 1, and measurement of the displacements.

To measure the spatial resolution of the lens 10, as illustrated in the block diagram in FIG. 3, a detector 44 consisting of a 50 μm diameter fiber with a 350 μm diameter metalized polymer film reflector attached is positioned at the center of the lens 10 at a distance of approximately 2.5 mm from a surface 46 of the lens. The distance of approximately 2.5 mm was determined to be a distance of maximum pressure for this exemplary configuration. A scanning laser vibrometer 48 is used to measure the response of the detector 44 at several positions across the focal plane. These measurements were taken in a line centered on the focal position spanning a total distance of approximately 14 mm. This corresponds to the diameter of the lens 10 indicated by line 50 on detector 44.

Figure 4:
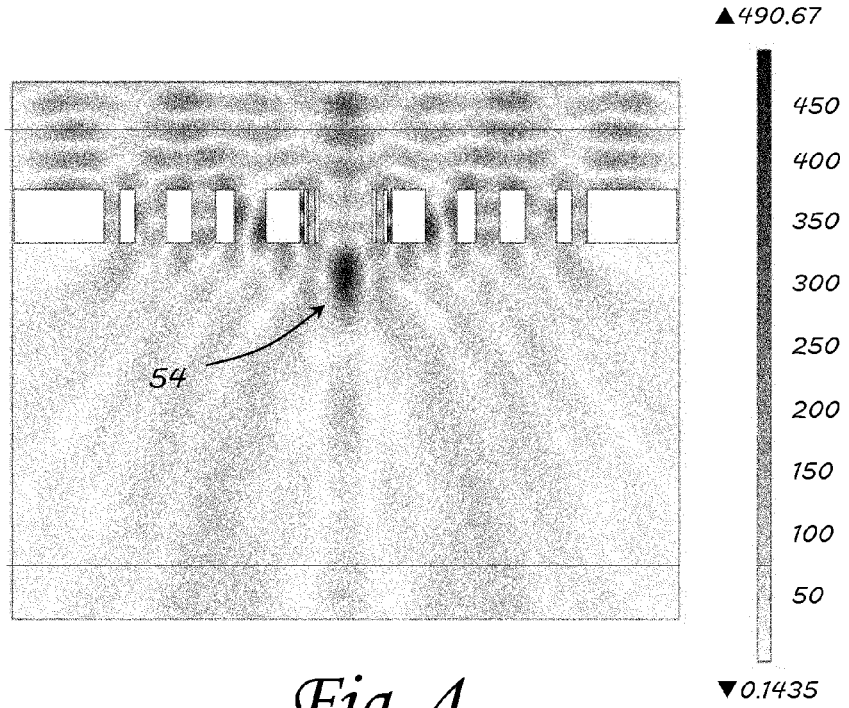
FIG. 4 is an output plot of a simulation of the exemplary acoustic lens in FIG. 1 with a 100 kHz incident wave.
Figure 5:
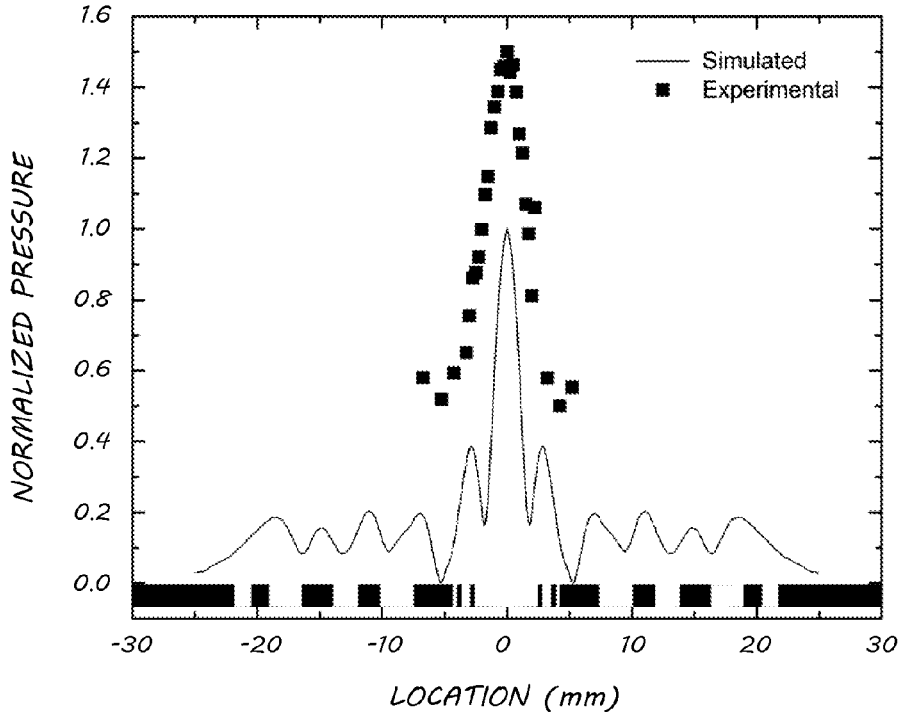
FIG. 5 is a plot of simulated and measured normalized pressure across a diameter of the exemplary acoustic lens in FIG. 1 at 82.9 kHz.

A schematic of the lens 10 structure and acoustic focusing is shown in FIG. 4. Acoustic plane waves generated by a piezoelectric transducer 52 are incident on the lens 10 and focused to a point 54 on the other side of the lens 10 structure directly opposite to the transducer 52. FIG. 5 shows the diameter cross-section of the lens 10 structure, computationally derived acoustic pressure at a distance of approximately 1.7 mm from the lens surface (focal plane) at approximately 82.9 kHz, and experimentally measured acoustic pressure at a distance of approximately 2.5 mm from the lens surface (focal plane) at approximately 82.9 kHz. The computed and experimentally measured acoustic pressures have been normalized to their highest pressures, 0-1 and 0.5-1.5 respectively, for comparison.

The distance between the lens and the detector, 2.5 mm, is less than one wavelength over the frequency range tested, and it is considered the near field. The acoustic pressure across the focal plane varies with the highest amplitude being at the center of the lens as illustrated in FIG. 5. This acoustic field pattern is similar to theoretically predicted and experimentally observed field patterns in similar contemporary lens structures designed for microwave, optical, and acoustic focusing. The spatial resolution of the lens 10 is defined as the width of the experimental pressure versus position curve at 3 dB below the peak, or full width at half maximum (FWHM). At 82.9 kHz, the spatial resolution is approximately 3.12 mm, which is approximately 0.75 of the wavelength of sound in air at the same frequency.

Figure 6:
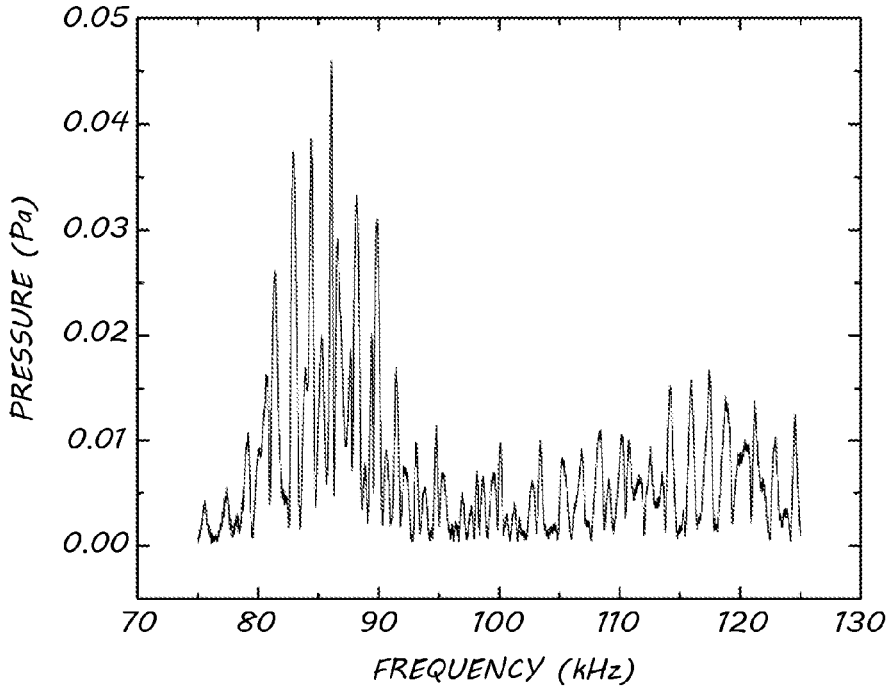
FIG. 6 is a plot of pressure vs. frequency showing resonances of the exemplary lens in FIG. 1 from 75-125 kHz.

To measure the frequency response of the lens over the range of 75-125 kHz, the detector 44 is again positioned at the center of the lens 10 at a distance of approximately 2.5 mm from the lens surface 46. The amplitude of the acoustic pressure is measured with the scanning laser vibrometer 48 while changing the input to the acoustic transducer 52 placed behind the lens 10. The pressure at a single point along the center axis of the lens is measured as a function of frequency. FIG. 6 shows the experimentally measured acoustic pressure variation with the frequency over 75-125 kHz. The lens 10 response has several resonances in the broad frequency range illustrating the broad band nature of the lens 10. The acoustic pressure response is strong in 75-90 kHz and 115-125 kHz bands; while in the 90-115 kHz band, the response of the lens is confounded by signal noise and low signal amplitude. The resonances are observed to be aperiodic in frequency and have varying widths. Additionally, several resonances appear very close to each other with some partially superimposed and some with very low amplitudes.

The existence of the multiple resonances can be explained qualitatively by considering the lens 10 as a combination of multiple circular rings. Each individual ring can be considered as a separate resonator with its own resonances. Hence, the resonances of the lens are a linear combination of the individual ring resonances. Therefore, it is reasonable to expect the lens to have multiple resonances. It is the combined effect of individual ring resonances that produce the observed high pressure amplitude at the focal point for multiple frequencies.

Figure 7:
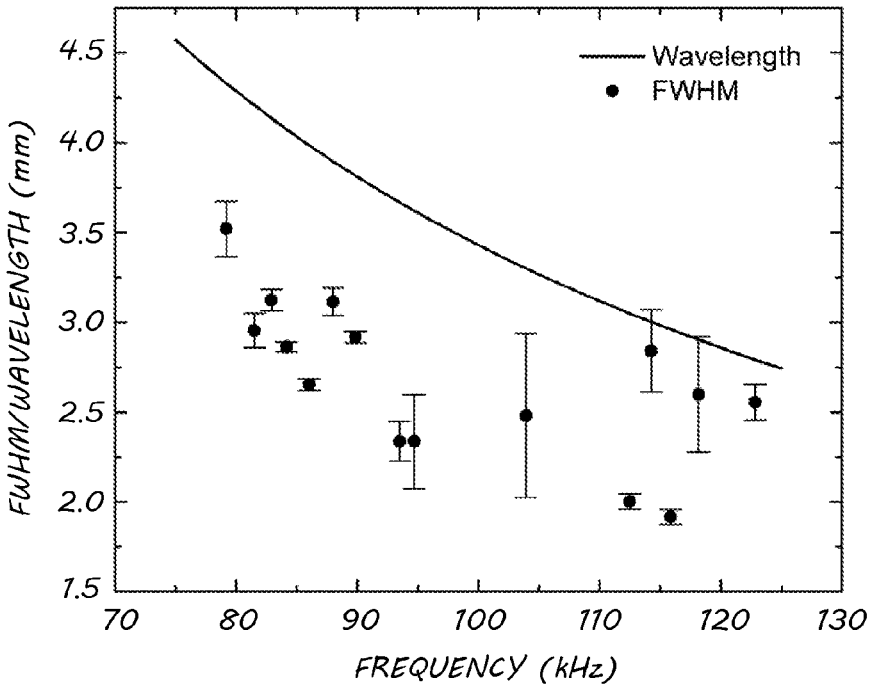
FIG. 7 is a plot of ultrasonic wavelength in air vs. frequency and measured 3 dB FWHM vs. frequency.

Clearly defined resonance peaks with pressure amplitudes greater than 9 mPa are analyzed to avoid problems associated with peaks containing overlapping resonances or low amplitudes. The method used previously to determine the spatial resolution at 82.9 kHz may also be used to determine the spatial resolution at all clearly defined resonances. FIG. 7 shows a plot of the spatial resolution of the lens, defined as FWHM, as a function of frequency for all clearly defined resonances in the frequency range of 75-125 kHz. For comparison, the ultrasonic wavelength as a function of frequency in air is plotted in the same figure. The parabolic behavior of the ultrasonic wavelength as a function of frequency in air is very well established in far field measurements. However, from the data presented here for near-field sub-wavelength focusing, this relationship is not valid. The spatial resolution for all the analyzed resonance frequencies is on average 25 percent higher than the far field wavelength while the distance from the surface of the lens is 73 percent of the far field wavelength at 100 kHz.

The observed sub-wavelength spatial resolution at each of the clearly defined resonances is a result of near field diffraction by the lens and follows from the interaction of incident radiation through a sub-wavelength aperture. The diffracted components of the evanescent waves carry the sub-wavelength features of the lens structure. The components of the evanescent acoustic waves combine to produce the acoustic pressure incident on the detector 44. Evanescent acoustic wave pressure displaces the detector 44, and those displacements are detected by a scanning laser vibrometer 48. This measurement set-up is similar in principle to near field scanning probe microscopies such as near field scanning optical microscopy (NSOM), near field evanescent microwave microscopy, ultrasonic force microscopy (UFM), and atomic force acoustic microscopy (AFAM). In all of these cases, diameter of the probe detecting the evanescent fields determines the spatial resolution rather than the excitation frequency. Based on the operating principles of near field scanning probe microscopy, using a smaller diameter metallic film reflector to detect the acoustic evanescent wave pressure may theoretically provide higher spatial resolution. Furthermore, a smaller probe may also assist to resolve the overlapping resonant peaks observed in FIG. 6. It is also possible that the lens 10 may have different focal distances at each frequency and could show less scatter if the acoustic pressure measurements are performed at distances from the lens 10 optimized for each resonance frequency.

Therefore, the results demonstrate the possibility of focusing ultrasound with sub-wavelength resolution at multiple frequencies in air over the observed frequency range of 75-125 kHz using a single acoustic lens. The response of the lens shows multiple distinct resonances as well as some which overlap. For the resonances that are clearly separated with strong amplitudes, the FWHM have an average spatial resolution 25 percent better than their corresponding wavelengths. The exemplary lens 10 presented has twelve resonances spanning over 40 kHz, which is a large bandwidth when compared to contemporary acoustic structures. It is possible that larger bandwidths, greater focusing, or longer focal distances could be achieved with further optimization.

Modeling the interaction of ultrasound with such a structure is a complex problem, and further modeling the resultant wave behavior after the interaction is also challenging. The complexity of these problems arise from parameters such as the number and type of boundaries involved, the number of reflections accounted for, the number and type of wave modes interacting, and how the focal spot is defined. For each dimension simulated this computational burden is multiplied. Several assumptions may be made to make the model more manageable. In some embodiments, a first assumption may be that the smallest spatial resolution corresponds to highest degree of focusing, which may be assumed to be at the point of maximum pressure. To further simplify the modeling, and in some embodiments, a two-dimensional approach may be used rather than an entire three-dimensional structure. Because of established parameters of radial symmetry for the design, the two-dimensional model may be examined at a maximum cross-sectional diameter at the center of the lens 10, which may be assumed to be the area of greatest focusing.

A goal of the theoretical and computational model is to determine the distribution of the acoustic pressure ahead of the structure, and to optimize the dimensions of the structure to obtain highest possible pressure with minimum focal spot diameter. For this purpose it is necessary to solve for the pressure in Eq. (1), $$\nabla^2 P + k^2 P = 0, \tag{1}$$

$$k = \frac{\omega}{c} \tag{2}$$

with the boundary conditions, $$n \cdot \nabla P_1 = n \cdot \nabla P_2, \tag{3}$$

where P is the pressure and c is the velocity of the longitudinal acoustic waves, ω is defined as 2πf, f is the frequency of the acoustic waves, n is the unit vector normal to the acoustic field and $\nabla P_1$ and $\nabla P_2$ are the pressure gradients on each side of the boundary. In addition to the boundary conditions, two other assumptions are made. First, the wavelength of sound in the solid structure is very large compared to the thickness of the structure at any location. Second, the stiffness of the solid structure is infinitely large compared to the fluid.

The solution for the acoustic pressure fields may be obtained from many different approaches such as finite element method or boundary element method as is known in the art. The complexities of the solution of Eq. (1) are not only in determining the pressure at all locations ahead of the structure, but also in optimizing of the dimensions of the structure. To perform both the computation and the optimization efficiently with high accuracy, for the exemplary embodiment of the lens 10 illustrated in FIG. 1, COMSOL MULTIPHYSICS® produced by The COMSOL Group of Stockholm, Sweden was used in conjunction with a custom hybrid algorithm created by splicing two existing optimization algorithms together. Other embodiments of the invention may be optimized using other commercially available analysis and/or optimization tools.

Due to the complexity associated with the optimization of acoustic lens design, the solution space is highly dimensional. Compared to more traditional optimization methods, such as gradient descent, genetic algorithms afford more flexibility to consider nonlocal candidate solutions. Genetic algorithms are designed to find an optimum set of values or features, referred to as genes. The genes used in the optimizing algorithm were represented by the material's state as a binary value of void (air) or solid (aluminum) in the lens structure. The diametric cross section of the lens was divided in to 127 rectangular slices of void and solid, though other divisions could have also been used. Although the through-thickness of each slice was designated with a binary value, the through-thickness of each slice could be varied in the optimization algorithm. However, using this binary simplification greatly increases the manufacturability of the optimized lens. The collection of all genes after optimization forms a linear lens and by rotating the structure about the axis of symmetry (such as axis 42 in FIG. 1) the three-dimensional lens structure was generated.

Genetic algorithms typically begin with two or more seeds, or randomly generated arrays of genes. The algorithm then splices, or mates, these seeds to generate a series of offspring. The quality of these offspring may then be evaluated by defining a fitness function to determine the best offspring, which are assigned as the parents in the following iteration. The process of breeding parents is repeated until a stopping criterion is met.

The randomness associated with genetic algorithms enables the consideration of multiple paths simultaneously. Multiple paths minimize the probability of premature convergence, as the likelihood that all of the paths will prematurely converge is less likely than the probability that one path will prematurely converge. While the inherent randomness may seem haphazard, genetic algorithms enable wide-scope optimization of problems that may not be realistically solvable via the brute force technique. However, it is possible for desirable genes to remain unrepresented by the parents and subsequent offspring. In addition, genetic algorithms are generally ineffective for finding global maximums for highly dimensional problems.

Another type of algorithm that is available is the greedy algorithm. Greedy algorithms break complicated problems into a series of smaller problems, or steps. Greedy algorithms optimize each step independently and combine the small scale optimizations to estimate the true global maximum.

Complex problems, like the work described here, make achieving the global maximum virtually impossible with a greedy algorithm; however, it is possible to obtain an optimized solution that is sufficiently close to the global maximum. Greedy algorithms are known for their "hill-climbing" capabilities. However, they are innately myopic, and are prone to becoming fixed at a particular local maximum.

Figure 8:
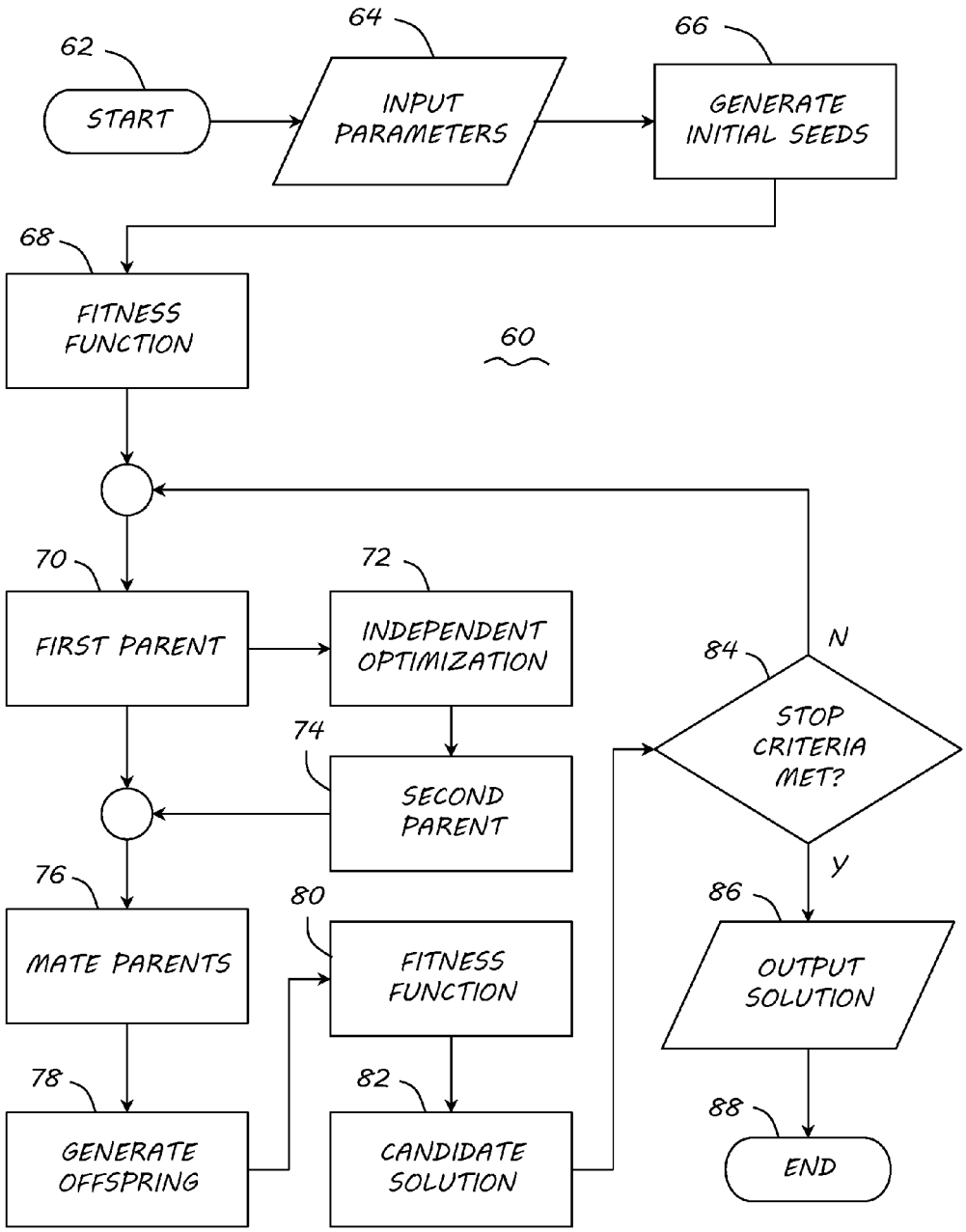
FIG. 8 is a flow chart of a hybrid algorithm and simulation process for designing an acoustic lens, such as the exemplary lens in FIG. 1.

By combining genetic and greedy algorithm attributes into a hybrid algorithm, some of the inherent downfalls of the base algorithms are mitigated while capturing the strengths of both as seen in flow chart 60 in FIG. 8. The algorithm begins at block 62. Parameters such as material properties associated with air and the ring material, frequency at which the lens will operate, width of the acoustic field, limits on the number of rings, among others may be input in block 64. Initially, the hybrid algorithm performs like a genetic algorithm. Numerous seeds are randomly generated in block 66 to start the algorithm. The hybrid algorithm selects only the single best candidate (based on the fitness function in block 68) to be the first parent in block 70 (opposed to selecting multiple seeds or offspring to mate in subsequent iterations). Fitness functions are utilized to selected candidate solutions based on, for example, maximum pressure, minimum spot diameter, distance of the spot from the lens, or any combinations of the preceding as well as other criteria.

The greedy algorithm aspect of the hybrid algorithm in block 72 now takes over to generate a second parent by independently switching a state (due to the binary simplification of the genes used) of each cell in the first parent, and determining whether the initial or switched value generates the largest fitness value. This process is repeated for each cell individually to generate a second parent in block 74 that includes the fittest state from every cell of the first parent. This process essentially finds the locally optimum direction that increases the fitness value the most. The genetic algorithm aspect of the hybrid algorithm resumes after the second parent is generated and the two parents are mated in block 76 to generate a new set of offspring in block 78. The offspring are evaluated with the fitness function in block 80 and the offspring with the largest fitness value is selected as the candidate for the new first parent in block 82. If a stopping criteria based on the fitness function is not met ("No" branch of decision block 84), the process is repeated at block 70. If the criteria is met ("Yes" branch of decision block 84), the optimized candidate solution is output at block 86, and the process ends at block 88.

This hybrid algorithm makes no real attempt to find a global maximum, which would likely be unrealistic for a problem of this complexity. Additionally, the goal of generating the second parent by a greedy algorithm is to introduce genes with desirable characteristics; the second parent is not a candidate solution. In complex problems, the fitness value for the second parent may be insignificant due to neglecting inter-cell dependencies and introducing competing optimization paths. However, by mating the parents through the genetic aspect of the algorithm, offspring with a portion of these new desirable genes are generated. The hybrid nature of this algorithm effectively takes advantage of the genetic algorithm's ability to randomly search a larger portion of the solution space while maintaining the greedy algorithm's ability to converge to a local maximum and introduce new genes.

In some embodiments, the hybrid algorithm may be implemented in MATLAB® produced by MathWorks of Natick, Mass. and may continually change the geometry parameters according to the iteration of the algorithm, sending those parameters to COMSOL®. The structure is then meshed and the pressure field is solved for over the entire domain for a time harmonic case by solving Eq. (1) for the two-dimensional case. Once the pressure field is found, the solution at the position of the focal point is returned from the COMSOL® script. The focal point pressure is the fitness (objective) function for the illustrated embodiment, though other objective and/or fitness functions may also be used. The genetic algorithm uses this solution as a comparison measure for each of the geometry cases, and the best is used as parents for the next generation.

The simulation of the acoustic lens in FIG. 1 is designed to focus 100 kHz incident acoustic waves to a point. This resulted in a three-dimensional circular ring structure with an overall diameter of approximately 40 mm. The focal length of the simulated lens structure is 6.7 mm and the focal spot diameter of the highest acoustic pressure is 1.7 mm in diameter.

Computer modeling and simulation approaches, combined with the hybrid genetic algorithm, show that a structure may be designed to produce a flat acoustic lens. The flat acoustic lens structure manufactured based on dimensions generated by computer model was experimentally evaluated as set out above. The manufactured lens, although optimized by computer modeling and simulation to operate at 100 kHz, operates most effectively in the frequency range of 80-90 kHz. Experimentally determined focal length and the spatial resolution differ from the computer simulation by 63 percent and 51 percent, respectively. A number of factors could cause the observed deviations of the experimental behavior from the simulation.

The most likely factors for the observed deviations are related to the excitation transducer 52 and manufacturing of the lens. The excitation transducer 52 used is nominally centered at 100 kHz. Characterization of the transducer 52 with the scanning laser vibrometer 48 showed that it has a center frequency of 85 kHz with a bandwidth of 10 kHz. The computer simulation, however, assumes a perfect 100 kHz source. Characterization of the excitation transducer to determine both the frequency and bandwidth, which could then be input as a parameter into the computer simulation, may be necessary to yield more accurate results from the simulation.

Although the design parameters obtained for fabricating the lens from the computer simulation are extremely precise, the tolerances during manufacturing could only be controlled to ±0.03 mm. This affects the dimension of the rings, and in particular the thinnest rings. The thinnest rings may deviate up to approximately 5 percent from the computer simulated design, which could have a significant impact on the performance characteristics of the lens 10. Furthermore, the computer simulation used a two-dimensional approximation that results in three-dimensional structure of concentric rings. During fabrication, webs 12 are added to hold the rings together as set forth above. The resulting increase in the complexity of the acoustic field distribution is an additional source of error. Also, for a periodic grating focusing in the far field, scattering from the central region of the lens structure is larger than the error due to scattering from the outer regions. In some embodiments, the lens may be coupled directly with a transducer, thus potentially eliminating the need for the webs 12.

While fabrication can alter the operating parameters of the lens, measurement of acoustic field distribution in air to determine spatial resolution of the lens is also challenging and can introduce uncertainties of its own. The fiber-disk arrangement is an innovative method to map the acoustic field distribution in air. The displacements of the fiber-disk depend on the elastic properties of both the fiber and the disk, and the tension in the fiber. The ideal situation to determine the spatial resolution is for the transducer, the lens, and the fiber-disk arrangement to be aligned coaxially. Small variations in this alignment will introduce errors particularly in the determination of both focal length and spatial resolution. Nonparallel arrangements can produce decreased spatial resolution compared with the theoretical calculations.

Developing structures to focus acoustic waves to a tight circular spot in air is important in acoustic imaging. These structures have the potential to improve the capabilities of scanning acoustic microscopy by enabling high resolution imaging, while eliminating the need for a coupling material. It is expected that sub-wavelength focusing lenses could significantly enhance the sensitivity of the air coupled ultrasonic nondestructive evaluation while maintaining the depth of penetration of inspections at low frequency. Applications to acoustic spectroscopy and medical ultrasound fields are foreseen as well.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. For example, embodiments of the air coupled acoustic lens: (1) may focus acoustic waves to a spatial resolution of less than one wavelength on the incident acoustic wave and (2) the lens is flat. The invention in its broader aspects is therefore not limited to the specific details, representative apparatus and method, and illustrative examples shown and described. Accordingly, departures may be made from such details without departing from the scope of the general inventive concept.

What is claimed is:

1. A broadband acoustic lens for focusing an incident acoustic wave comprising:

a plurality of concentric rings, wherein each concentric ring of the plurality of concentric rings has a ring width;

a plurality of gaps, wherein each gap of the plurality of gaps has a spacing;

the concentric rings being separated by a spacing corresponding to a gap of the plurality of gaps;

the widths of the plurality of concentric rings and the spacings of the plurality of gaps being arranged such that the incident acoustic wave is focused to a spot within a sub-wavelength of the incident acoustic wave in air, and wherein the arrangement of the widths of the plurality of concentric rings and spacings of the plurality of gaps is aperiodic.

2. The broadband acoustic lens of claim 1, wherein the aperiodic arrangement of the widths of the plurality of concentric rings and spacings of the plurality of gaps focuses the incident acoustic wave to a spot within a sub-wavelength of the incident acoustic wave at a plurality of acoustic frequencies.

3. The broadband acoustic lens of claim 1, further comprising:

a webbing interconnecting the plurality of concentric rings to maintain the spacings of the plurality of gaps.

4. The broadband acoustic lens of claim 3, wherein the webbing interconnecting the plurality of concentric rings divides the acoustic lens into four quadrants.

5. The broadband acoustic lens of claim 1, wherein the plurality of concentric rings consist of aluminum.

6. The broadband acoustic lens of claim 1, wherein each of the plurality of concentric rings has an equal thickness and is coplanar.

7. The broadband acoustic lens of claim 1, wherein the aperiodic arrangement of the widths of the plurality of concentric rings and spacings of the plurality of gaps is axially symmetric.

8. A method of designing a broadband acoustic lens, the method comprising:

generating a plurality of initial seed designs of the broadband acoustic lens, wherein each design of the plurality of initial seed designs includes:

a plurality of concentric rings, wherein each concentric ring of the plurality of concentric rings has a ring width;

a plurality of gaps, wherein each gap of the plurality of gaps has a spacing;

the concentric rings being separated by a spacing corresponding to a gap of the plurality of gaps;

the widths of the plurality of concentric rings and the spacings of the plurality of gaps being arranged such that the incident acoustic wave is focused to a spot within a sub-wavelength of the incident acoustic wave in air, and wherein the arrangement of the widths of the plurality of concentric rings and spacings of the plurality of gaps is aperiodic;

selecting a design of the plurality of initial seed designs using a fitness function;

generating a first parent design from the selected design;

optimizing the first parent design to generate a second parent design by adjusting features of the first parent design selected from a group consisting of: number of rings of the plurality of concentric rings, widths of the rings of the plurality of concentric rings, spacings of the plurality of gaps, material properties of each ring of the plurality of concentric rings, and combinations thereof;

mating the first and second parent designs to generate a plurality of offspring;

evaluating each of the plurality of offspring to select a candidate solution; and in response to the candidate solution not meeting a stop criteria, setting the first parent as the candidate solution and repeating the optimizing, mating, and evaluating.

9. The method of claim 8, wherein the first parent design is optimized utilizing a hybrid of a genetic and greedy algorithm.

10. The method of claim 8, wherein the fitness function is selected from a group consisting of: maximum pressure, minimum spot diameter, distance of a spot from a lens, and combinations thereof.

11. The method of claim 8, further comprising:

inputting analysis parameters for generating the plurality of initial seed designs.

12. The method of claim 11, wherein the analysis parameters are selected from a group consisting of: material properties of air, material properties of rings, operating frequency, width of acoustic field, design limitations, and combinations thereof.

* * * * *